US012653233B2

(12) United States Patent
Bessant et al.

(10) Patent No.: US 12,653,233 B2
(45) Date of Patent: Jun. 16, 2026

(54) AEROSOL-GENERATING DEVICE WITH A SELF-SUPPORTING COMPONENT

(71) Applicant: Philip Morris Products S.A., Neuchatel (CH)

(72) Inventors: Michel Bessant, Neuchatel (CH); Silviu Natanael Pantea, Neuchatel (CH); Jun Wei Yim, Colombier (CH); Grégori Ischi, Bole (CH); Jun Jie How, Muar (MY); Dennis Yape Dela Paz, General Trias Cavite (PH)

(73) Assignee: Philip Morris Products S.A., Neuchatel (CH)

( * ) Notice: Subject to any disclaimer, the term of this patent is extended or adjusted under 35 U.S.C. 154(b) by 480 days.

(21) Appl. No.: 18/250,292

(22) PCT Filed: Oct. 25, 2021

(86) PCT No.: PCT/EP2021/079537
§ 371 (c)(1),
(2) Date: Apr. 24, 2023

(87) PCT Pub. No.: WO2022/090154
PCT Pub. Date: May 5, 2022

(65) Prior Publication Data

US 2023/0413901 A1 Dec. 28, 2023

(30) Foreign Application Priority Data

Oct. 28, 2020 (EP) ..... 20204488

(51) Int. Cl.
*A24F 40/40* (2020.01)
*A24F 40/20* (2020.01)

(52) U.S. Cl.
CPC ..... *A24F 40/40* (2020.01); *A24F 40/20* (2020.01)

(58) Field of Classification Search
None
See application file for complete search history.

(56) References Cited

U.S. PATENT DOCUMENTS 11,134,717 B2 * 10/2021 Naughton ..... A24F 40/85
2017/0303598 A1 10/2017 Li et al.
(Continued)

FOREIGN PATENT DOCUMENTS

CN 104256898 A 1/2015
CN 111109669 A 5/2020
(Continued)

OTHER PUBLICATIONS

International Search Report & Written Opinion issued Feb. 8, 2022 in PCT/EP2021/079537 filed Oct. 25, 2021, 12 pages.
(Continued)

*Primary Examiner* — Dennis R Cordray
(74) *Attorney, Agent, or Firm* — Oblon, McClelland, Maier & Neustadt, L.L.P.

(57) ABSTRACT

An aerosol-generating device is provided, including: a heater casing housing a heating chamber, the heating chamber configured to receive an aerosol-generating article including an aerosol-forming substrate; an air-flow tube configured to provide air to the heating chamber; and a controller configured to control operation of the aerosol-generating device, in which the heater casing, the air-flow tube, and the control element are mounted to one another and form a self-supporting component of the aerosol-generating device. A self-supporting component for an aerosol-generating device, and an aerosol-generating system including the aerosol-generating device and an aerosol-generating article, is also provided.

13 Claims, 6 Drawing Sheets

(56) References Cited

U.S. PATENT DOCUMENTS

| | | | | |
|---|---|---|---|---|
| 2018/0168224 | A1 | 6/2018 | Naughton et al. | |
| 2021/0378302 | A1 | 12/2021 | Naughton et al. | |
| 2022/0175047 | A1* | 6/2022 | Fung | A24F 40/70 |
| 2022/0191979 | A1* | 6/2022 | Sayed | H05B 6/108 |

FOREIGN PATENT DOCUMENTS

| | | | |
|---|---|---|---|
| CN | 107536113 | B | 10/2023 |
| JP | 2019-524099 | A | 9/2019 |
| JP | 2020-14433 | A | 1/2020 |
| KR | 10-2018-0014026 | A | 2/2018 |
| RU | 2 671 615 | C1 | 11/2018 |
| WO | WO 2015/149313 | A1 | 10/2015 |
| WO | WO 2016/207407 | A1 | 12/2016 |
| WO | WO 2020/084758 | A1 | 4/2020 |
| WO | WO 2020/182751 | A1 | 9/2020 |
| WO | WO 2020/199214 | A1 | 10/2020 |

OTHER PUBLICATIONS

Japanese Office Action issued Jun. 26, 2024 in Japanese Patent Application No. 2023-526263, 2 pages.

Combined Russian Office Action and Search Report issued Oct. 26, 2023 in Russian Patent Application No. 2023109852/03 (with English Translation), 17 pages.

Notice of Allowance dated Apr. 1, 2026, issued in corresponding Korean patent application No. 10-2023-7014017 (with English translation).

* cited by examiner

AEROSOL-GENERATING DEVICE WITH A SELF-SUPPORTING COMPONENT

The present invention relates to an aerosol-generating device. The present invention further relates to a self-supporting component for use in an aerosol-generating device. The present invention further relates to an aerosol-generating system comprising an aerosol-generating device. The present invention further relates to a method for manufacturing an aerosol-generating device.

Aerosol-generating devices are known which heat but which do not burn aerosol-forming substrates in aerosol-generating articles such as tobacco. Such devices heat the aerosol-forming substrates to a sufficiently high temperature for generating an aerosol for inhalation by the user. These aerosol-generating devices normally include a heating chamber, further components for defining an air flow path through the device, electronics for controlling the device and a power source for providing energy to the device. These devices are typically portable, hand-held devices and are required to be compact.

Devices for heating smokable material are known which include a housing into which various components, such as a power source, control circuitry and a heater are mounted. The assembly of the individual components in the housing is quite complicated and requires various separate manufacturing steps.

It would be desirable to provide an aerosol-generating device which can easily be assembled and which is compact.

According to an embodiment of the present invention an aerosol-generating device is provided. The aerosol-generating device may comprise a heater casing housing a heating chamber, wherein the heating chamber is configured for receiving an aerosol-generated article comprising an aerosol-forming substrate. The aerosol-generating device may comprise an air-flow tube configured for providing air to the heating chamber. The aerosol-generating device may comprise a control element configured for controlling operation of the aerosol-generating device. In the aerosol-generating device the heater casing, the air-flow tube and the control element may be mounted to one another and may form a self-supporting component of the aerosol-generating device.

According to an embodiment of the invention there is provided an aerosol-generating device. The aerosol-generating device comprises a heater casing housing a heating chamber, wherein the heating chamber is configured for receiving an aerosol-generating article comprising aerosol-forming substrate. The aerosol-generating device furthermore comprises an air-flow tube configured for providing air to the heating chamber, and a control element configured for controlling operation of the aerosol-generating device. The heater casing, the air-flow tube and the control element are mounted to one another and form self-supporting component of the aerosol-generating device.

The overall design of the aerosol-generating device may be compact due to the self-supporting component. The self-supporting component may simplify the assembly of the aerosol-generating device. The self-supporting component may support itself and its own weight without the necessity for an external frame for arranging the heater casing, the air-flow tube and the control element relative to each other. The heater casing, the air-flow tube and the control element may hold each other in position. This may assist in forming the self-supporting component of the aerosol-generating device. The self-supporting component may form a separate unit of the aerosol-generating device. The separate unit may be a one-piece. This one-piece may be easily handled as one single component during the assembly of the aerosol-generating device. This may reduce the number of components during the assembly of the aerosol-generating device, simplifying the assembly process for the aerosol-generating device.

As used herein, the terms "upstream", and "downstream", are used to describe the relative positions of components, or portions of components, of the aerosol-generating device in relation to the direction in which air flows through the aerosol generating device during use thereof along the air flow path. Aerosol generating devices according to the invention comprise a proximal end through which, in use, an aerosol exits the device. The proximal end of the aerosol generating device may also be referred to as the mouth end or the downstream end. The mouth end is downstream of the distal end. The distal end of the aerosol generating article may also be referred to as the upstream end. Components, or portions of components, of the aerosol generating device may be described as being upstream or downstream of one another based on their relative positions with respect to the airflow path of the aerosol generating device.

The heater casing may comprise a heater casing downstream part and a heater casing upstream part. The heater casing downstream part may be mounted to the heater casing upstream part. This may form the heater casing for housing the heating chamber. One or both of the heater casing downstream part or the heater casing upstream part may comprise connections configured for mounting the heater casing upstream part to the heater casing downstream part. Preferably both the heater casing downstream part and the heater casing upstream part may comprise these connections. These connections may comprise one or both of a snap-fit connection and a screw connection. A snap-in area may be formed on one of the heater casing upstream part or the heater casing downstream part and a corresponding lever may be formed on the other one of the heater casing upstream part or the heater casing downstream part in order to provide the snap-fit connection. Upon engaging the lever with the corresponding snap-in area, that lever may connect with the snap-in area, thereby forming the snap-fit connection. In case of a screw connection, threads for the screw connections may be provided on both the heater casing downstream part and the heater casing upstream part. This may ensure that both the heater casing downstream part and the heater casing upstream part may easily be connected to each other via a screw. A screw connection may be preferred.

In one embodiment of the aerosol-generating device, the heater casing upstream part and the air-flow tube may be formed as a one-piece element. This one-piece element may be formed for example via moulding, for example injection moulding. This may enable an easy one-piece connection between the heater casing upstream part and the air-flow tube without the necessity of forming connections configured for mounting the heater casing upstream part to the air-flow tube. When the heater casing downstream part and the one-piece element comprising the heater casing upstream part and the air-flow tube are mounted to each other, a component of the aerosol-generating device is formed, which contains both the heater casing and the air-flow tube. This may provide a continuous air flow path through the aerosol-generating device. Such an air flow path through the air-flow tube and the heater casing may avoid directing any air flow above or through the control element. This may reduce the risk of damaging the control element during operation of the aerosol-generating device. Such a continuous airflow path also might be easier to clean for example by using a brush.

Such a one-piece element comprising the heater casing upstream part and the air-flow tube may be preferred and may provide a central element for forming the self-supporting component. Preferably, the heater casing upstream part and the air-flow tube are directly connected to each other in the one-piece element. In particular, no additional elements may be present between the heater casing upstream part and the air-flow tube in the one-piece element.

Alternatively, the heater casing may form a one-piece element. In this case, the heater casing may be mounted to the air-flow tube. This may provide a continuous air flow path through the aerosol-generating device. Preferably, the heater casing may be directly mounted to the air-flow tube. In particular, no additional elements may be present between the heater casing and the air-flow tube. The heater casing mounted to the air-flow tube also may provide a central element for forming the self-supporting component.

The air-flow tube may comprise a downstream end and an upstream end, defining at least a part of the airflow path through the aerosol-generating device. Air may enter the aerosol-generating device through the upstream end of the air-flow tube. Air may further be directed through the downstream end of the air-flow tube into the heater casing. This may provide parts of the air-flow path through the aerosol-generating device in a particular easy way.

When the self-supporting component is assembled, the heater casing and the air-flow tube may be in direct contact. A downstream portion of the air-flow tube may be in contact with the heater casing, in particular the heater casing upstream part.

The heater casing may comprise a thermal insulation. This thermal insulation may insulate the interior of the heater casing, housing the heating chamber from the exterior of the heater casing. The thermal insulation may avoid or reduce the transfer of any heat from the heating chamber to the control element. This may therefore avoid any negative impact on the control element. Integrating the thermal insulation into the heater casing also may provide a compact self-supporting component.

The heater casing may comprise inner walls. The inner walls of the heater casing may comprise one or both of a thermally reflective coating, and a polymer. The thermally stable polymer may be selected from a group of polymers consisting of polyphenylene sulfone (PPSU) and polyether ether ketone (PEEK). Preferably, the thermally stable polymer may comprise a polyphenylene sulfone (PPSU). The thermally reflective coating may comprise a metal. Such a metal coating may reflect the heat emitted from the heating chamber of the heater casing. The metal coating may comprise metals such as gold or aluminium, preferably gold. The inner walls of the heater casing also may comprise a heat insulation material.

The heating chamber is configured for receiving an aerosol-generating article comprising an aerosol-forming substrate. The heating chamber may comprise a cavity into which the aerosol-generating article is inserted. The cavity may be tubular. The cavity may include a thermally conductive material. The cavity may comprise a tube made of metal, preferably stainless-steel or the tube may comprise a ceramic. The heating chamber may comprise an opening at the downstream end of the heating chamber for receiving the aerosol-generating article. The opening may also serve as an air outlet.

The heating chamber may comprise a heating element configured for heating the aerosol-generating article. The heating element may comprise a substrate layer of flexible material. The substrate layer may comprise a thermally stable polymer, preferably polyimide.

The heating element may be arranged on the substrate layer. The heating element may be a resistive heating element. The heating element may contain wire connections configured for being connected with the control element. The heating element may comprise heating tracks arranged on the substrate layer. The heating tracks may comprise a thermally conductive material, preferably metals, such as stainless steel. The heating tracks may be electrically connected to said wire connections.

In particular, the heating chamber may comprise a tube made of metal wrapped into said substrate layer of flexible material, wherein the heating elements are arranged on the substrate layer.

The portion of the heating element, which is in contact with the aerosol-forming substrate is heated as a result of the electrical current passing through the heating element. The current is supplied by a power source. In one embodiment, this portion of the heating element is configured to reach a temperature of between about 140 degree Celsius and about 270 degree Celsius in use. Preferably, the heating element is configured to reach a temperature of between about 180 degree Celsius and about 240 degree Celsius.

The heating chamber configured for receiving the aerosol-forming article may be housed in the heater casing and may be spaced apart from the inner walls of the heater casing. This may provide thermal insulation between the inner walls of the heater casing and the heating chamber in which heat is generated. The space between the inner walls of the heater casing and the heating chamber may be airtight. The space may be filled with air. The space may also be filled with a gaseous mixture, preferably an inert gas such as nitrogen. This may provide a particularly good insulation between the inner walls of the heater casing and the heating chamber.

The heater casing may comprise a downstream heater opening for inserting the aerosol-generating article into the heating chamber. The downstream heater opening may be located at the downstream end of the airflow path through the aerosol-generating device.

The air-flow tube may comprise heat stable polymers. The air-flow tube may comprise the same heat stable polymers as the heater casing. In particular, the one-piece element comprising the heater casing upstream part and the air-flow tube on the one hand and the heater casing downstream part on the other hand may comprise the same heat stable polymers. The air-flow tube or the one-piece element, respectively, may comprise one or both of polyphenylene sulfone (PPSU) and polyether ether ketone (PEEK).

In the aerosol-generating device, the air-flow tube may be mounted to the control element. The air-flow tube and the control element may be in direct contact. This may provide a particular simple self-supporting element. Preferably, the air-flow tube may be directly mounted to the control element.

The air-flow tube and the control element may both contain connectors configured for mounting the air-flow tube to the control element. The connectors located on the air-flow tube and the control element may provide a snap-fit connection, similar to the connection described above between the heater casing and the air-flow tube. Additionally, or alternatively, the connectors may provide a screw connection.

At least one of the connectors located on either the air-flow tube or the control element may comprise a mounting boss for providing the connection between the air-flow tube and the control element. The air-flow tube may comprise at least one mounting boss configured for mounting the air-flow tube to the control element. The mounting boss may provide an easy way of connecting the air-flow tube to the control element, despite the air-flow tube and the control element having different geometrical shape. The air-flow tube may have a tubular shape. The control element may comprise a supporting substrate, preferably a printed circuit board and therefore may have a flat shape. Control circuitry may be arranged on the supporting substrate of the control element. The control circuitry is configured for controlling the operation of the aerosol-generating device and may comprise one or more microprocessors or microcontrollers. The control element, in particular its supporting substrate may comprise at least one through hole configured for mounting the control element to the air-flow tube. The at least one through hole of the control element may be configured to connect to the mounting boss of the air-flow tube.

The at least one mounting boss of the air-flow tube may extend from the tubular body of the air-flow tube. The at least one mounting boss may extend from the tubular body of the air-flow tube in a perpendicular way. This may allow that the air-flow tube is mounted to the control element "side-by-side", wherein the control element, preferably a flat control element comprising a flat supporting substrate is mounted adjacent to the air-flow tube, in particular adjacent to the tubular body of the air-flow tube.

The mounting boss of the air-flow tube may comprise a thread for accommodating a screw. The at least one through hole in the supporting substrate of the control element may be configured to receive a screw. This may allow a particular easy mounting of the air-flow tube to the control element by using a screw and connecting the air-flow tube via its mounting boss through the through hole to the control element.

The invention also relates to an aerosol-generating device which further comprises a power source holder configured for holding a power source for powering the control element. The power source holder, the heater casing, the air-flow tube and the control element may be mounted to one another forming said self-supporting component. This may allow the formation of a self-supporting component including all major components of the aerosol-generating device. The components, the heater casing, the air-flow tube, the control element and the power source holder may hold each other in position, thereby creating the self-supporting structure.

The power source holder may furthermore comprise the power source, for example a battery. The self-supporting component then may comprise the heater casing, the air-flow tube, the control element and the power source holder together with the power source. Such a self-supporting component including all major elements with the power source may easily be housed in an outer casing. This may avoid the necessity to re-open the outer casing again in order to insert the power source into the power source holder.

The power source may be any suitable power supply, for example a DC voltage source such as a battery. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

The power source holder may be mounted to the control element. The power source holder may be in direct contact with the control element. The power source holder may comprise at least one through hole for mounting of the control unit to the power source holder. The at least one through hole of the power source holder may coincide with the through hole of the control element once the power source holder is brought into direct contact with the control element.

A connection element may be present in the self-supporting component, the connection element directly connecting the power source holder to the control element and the control element to the air-flow tube. That connection element may be passed through the through hole of the power source holder, and the through hole of the control element or supporting substrate into the thread of the mounting boss of the air-flow tube. Such a connection is particularly well suited for mounting the air-flow tube, the control element and the power source holder to one another in one step by using one connection element. The connection element may comprise one or both of a screw or a clip, preferably a screw.

Preferably at least two connections may be present in the self-supporting component. These at least two connections may directly mount the power source holder to the control element and the control element to the air-flow tube. In particular, the air-flow tube may comprise two protruding mounting bosses, each including a thread for a connection element. Similarly, both the power source holder and the control element may comprise two through holes each, for passing the connection elements through the through holes and into the threads of said mounting bosses of the air-flow tube. The at least two connection elements may comprise screws.

The control element may be sandwiched between the air-flow tube and the power source holder. This may enable a particular compact design of the self-supporting component of the aerosol-generating device.

The aerosol-generating device may be devoid of any frame positioning the heater casing, the air-flow tube, the control unit and—if present—the power source holder relative to each other. The frame is not necessary since the heater casing, the air-flow tube, the control unit and the power source are included in the self-supporting component of the aerosol-generating device.

The invention also relates to an aerosol-generating device which further may comprise an outer casing, wherein the self-supporting component may be housed at least partly within the outer casing. The self-supporting component including the heater casing, the air-flow tube, the control unit and—if present—the power source holder may be an internal component of the aerosol-generating device. Preferably, the self-supporting component may be housed completely within the outer casing of the aerosol-generating device. Providing such a self-supporting component may ease the testing of the internal components of the aerosol-generating device included in the self-supporting component for correct functioning, before the self-supporting component is inserted into the outer casing.

The air-flow tube, preferably its downstream end, may comprise mounting bosses for engaging with the outer casing. The outer casing may comprise an upstream opening corresponding to the upstream end of the air-flow tube. This may provide an air inlet for outside air entering the aerosol-generating device, in particular the air-flow tube.

The outer casing may comprise a downstream opening configured for inserting the aerosol-generating article into the heating chamber. The downstream opening may be located at the downstream end of the airflow path through the aerosol-generating device. The downstream opening of the outer casing may coincide with the downstream heater opening of the heater casing. This allows the insertion of an aerosol-generating article through the downstream opening of the outer casing and the downstream heater opening of the heater casing into the heating chamber located in the heater casing.

The outer casing may comprise an upstream opening, which may coincide with the upstream end of the air-flow tube. Thus, a continuous airflow path can be provided through the aerosol-generating device, wherein the air enters the aerosol-generating device through the upstream opening of the outer casing and is directed through the upstream end of the air-flow tube to the downstream end of the air-flow tube into the heater casing. The airflow path may be directed through the heater casing upstream part to the heater casing downstream part through the heating chamber housed in the heater casing. An aerosol may be generated in the heating chamber via heating of an aerosol-generating article received in the heating chamber. This aerosol may leave the aerosol-generating device via the downstream heater opening and the downstream opening of the outer casing into the user's mouth.

The self-supporting component may be connected to the interior of the outer casing. The self-supporting component may be fixed or clamped into the interior of the outer casing.

At least one connection boss configured for connecting the outer casing to the self-supporting component may be present in the interior of the outer casing. The at least one connection boss may comprise a thread configured for accommodating a screw. The self-supporting component, in particular one or both of the air-flow tube or of the power source holder may comprise a protrusion with a through hole for passing through a screw. The outer casing may be connected to the self-supporting component by passing a screw through said protrusion with the through hole of the self-supporting component into the thread of the connection boss of the outer casing and securing the screw.

The outer casing may comprise a top housing and a bottom housing. The top housing may engage with the bottom housing to provide the closed outer casing for housing the self-supporting component in its interior. This may provide an outer casing including two components. The self-supporting component firstly may be connected to the top housing and then the bottom housing might be engaged with the top housing in order to provide the complete outer casing of the aerosol-generating device.

In particular, a snap-fit connection may be provided between the self-supporting component and the top housing of the outer casing. This may facilitate an easy connection between the self-supporting component and the top housing of the outer casing by simply sliding the self-supporting component into the top housing of the outer casing, leading to the snap-fit connection. For example, a lever may be formed in the power source holder, which can engage with a corresponding snap-fit area provided in the interior of the top housing of the outer casing. Such a snap-fit connection can easily be released by applying pressure to the top housing of the outer casing along the longest with of the top housing. The top housing of the outer casing may cover only parts of the self-supporting component.

After the self-supporting component has been connected to the top housing of the outer casing, the bottom housing of the outer casing may be slid over parts of the self-supporting component which are not yet covered by the top housing of the outer casing. External protrusions may be provided in both the top housing and the bottom housing of the outer casing, which include threads for accommodating a connection element, for example screws. These connection elements can be used in order to connect the top housing to the bottom housing of the outer casing.

Alternatively, the outer casing may comprise an outer casing body and a cover. The outer casing body may comprise an opening. The opening may serve for inserting the self-supporting component within the outer casing body. The opening furthermore may engage with the cover for providing a closed outer casing. The outer casing body may be pivotably connected to the cover. This may form one-piece outer casing for housing the self-supporting component. This one-piece outer casing may be larger than the outer casing comprising the top housing and the bottom housing as two separate parts.

The outer casing may comprise a polymer, preferably a thermally stable polymer. The polymer may be selected from a group of polymers consisting of polyphenylene sulfone (PPSU), Polyethersulfon (PESU), polyether ether ketone (PEEK), and acrylonitrile butadiene styrene (ABS), the ABS may be mixed with glass fibers. Preferably, the thermally stable polymer may comprise a polyphenylene sulfone (PPSU) or Polyethersulfon (PESU).

The invention also relates to a self-supporting component for use in an aerosol-generating device. The self-supporting component may comprise a heater casing for housing a heating chamber for an aerosol-generating article. The self-supporting component may comprise an air-flow tube configured for providing air to the heater casing. The self-supporting component may comprise a control unit. The control unit may be configured for controlling the temperature of the heating chamber. The control unit also may be configured for controlling the user interface, for example the LED's, the power bottom and the USB port for charging and communicating with the aerosol-generating device. The heater casing, the air-flow tube and the control unit may be mounted to one another. This may provide a self-stabilization of the self-supporting component wherein the heater casing, the air-flow tube and the control element hold each other in position.

The invention also provides a self-supporting component for use in an aerosol-generating device comprising:

- a heater casing for housing a heating chamber for an aerosol-generating article
- an air-flow tube configured for providing air to the heater casing, and
- a control unit, wherein the heater casing, the air-flow tube and the control unit are mounted to one another.

In particular, the heater casing may comprise heater casing downstream part and a heater casing upstream part. Heater casing upstream part and the air-flow tube may be formed as a one-peace element. Alternatively, the heater casing be directly mounted to the air-flow tube. This may provide an air flow path through the self-supporting component.

The self-supporting component furthermore may comprise a heating chamber, the heating chamber being housed in the heater casing.

The self-supporting component additionally may comprise a power source holder. The heater casing, the air-flow tube, the control element and the power source holder may be mounted to each other, thereby providing the self-supporting component.

The parts of the self-supporting component may be connected to each other, as explained above in relation to the self-supporting component being a part of the aerosol-generating device.

The invention also relates to an aerosol-generating system comprising an aerosol-generating device as described herein and an aerosol-generating article. The aerosol-generating article may comprise an aerosol-forming substrate. The aerosol-forming substrate may be in the form of a rod.

As used herein, the term "aerosol-forming substrate" refers to a substrate capable of releasing volatile compounds that can form an aerosol. The volatile compounds may be released by heating or combusting the aerosol-forming substrate. The aerosol-forming substrate may be solid or liquid or may comprise both solid and liquid components. An aerosol-forming substrate may be part of an aerosol-generating article.

As used herein, the term "aerosol-generating article" refers to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth. An aerosol-generating device may be a holder. The device is preferably a portable or handheld device that is comfortable to hold between the fingers of a single hand.

The invention also relates to a method for manufacturing an aerosol-generating device. The method may include the step of providing a heater casing comprising a heating chamber configured for receiving an aerosol-generating article. The method may include a step of providing an air-flow tube configured for providing air to the heating chamber. The method may include a step of providing a control unit configured for controlling the aerosol-generating device. The method may comprise mounting the heater casing, the air-flow tube and the control unit to one another, thereby providing a self-supporting component of the aerosol-generating device.

The invention also relates to a method for manufacturing an aerosol-generating device, comprising the steps of:

- providing a heater casing comprising a heating chamber configured for receiving an aerosol-generating article, an air-flow tube configured for providing air to the heating chamber, and the control unit configured for controlling the aerosol-generating device, and
- mounting the heater casing, the air-flow tube and the control unit to one another thereby providing a self-supporting component of the aerosol-generating device.

The method furthermore may comprise the steps of providing a power source holder. The power source holder may comprise the power source. The power source, such as a battery may be fixed to the power source holder by an adhesive, for example a double-sided adhesive tape. The method may comprise mounting the heater casing, the air-flow tube, the control unit and the power source holder to one another, thereby providing a self-supporting component of the aerosol-generating device.

The method additionally may comprise providing an outer casing, and mounting said self-supporting component at least partly in the outer casing. Preferably, the self-supporting component is mounted completely within the interior of the outer casing.

In the following, the invention will be described in more detail by the way of figures and embodiments. Features described in relation to one embodiment may equally be applied to other embodiments of the invention. The same elements are denoted with the same reference numerals throughout the figures.

The invention will be further described, by way of example only, with reference to the accompanying drawings in which.

Figure 1:
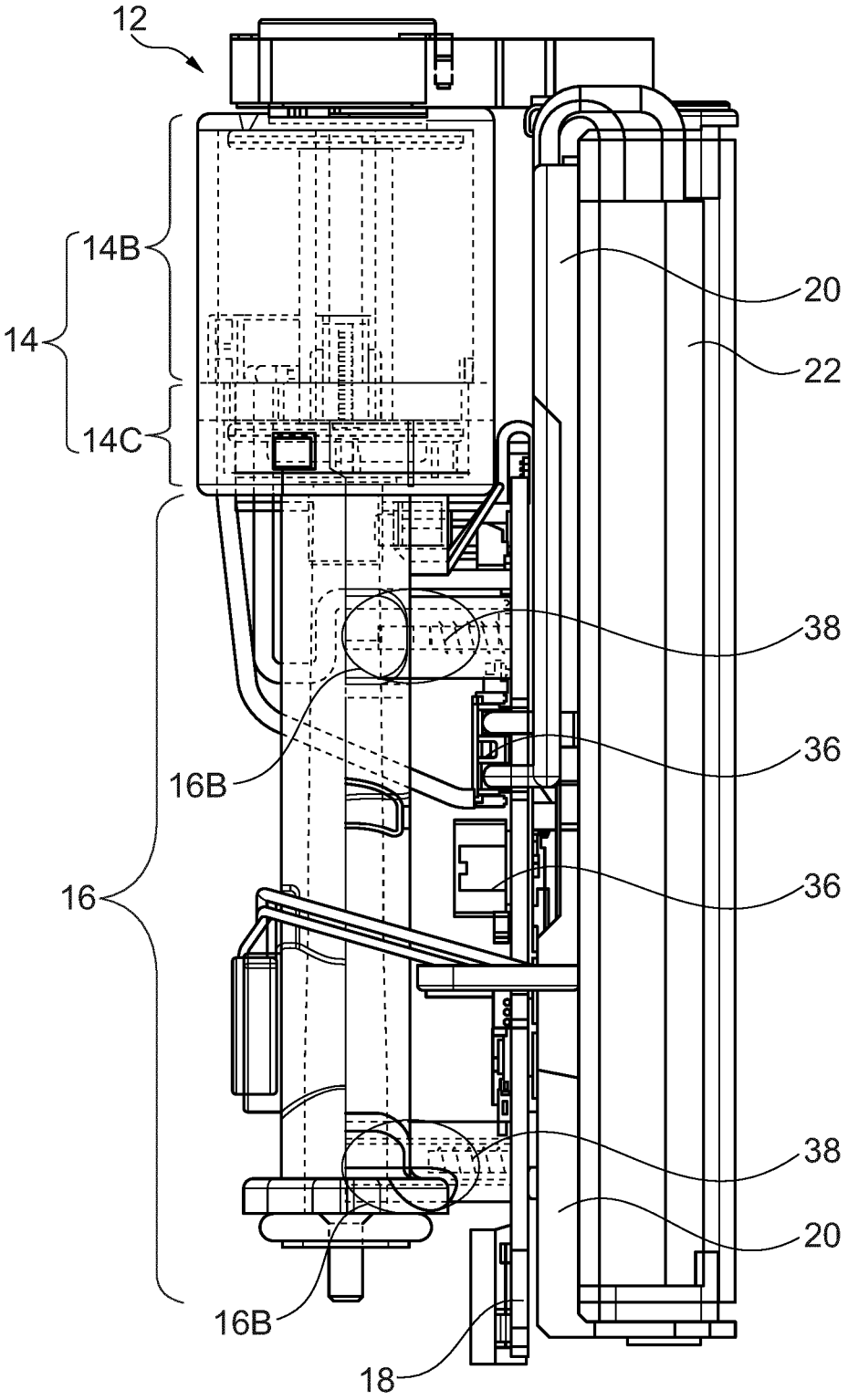
FIG. 1 shows a side view of a self-supporting component including a heater casing, an air-flow tube, a control element and a power source holder with a power source.

FIG. 1 depicts a side view of the self-supporting component 12 including a heater casing 14, which comprises a heater casing downstream part 14B and a heater casing upstream part 14C. The heater casing upstream part 14 C and an air-flow tube 16 are formed as a one-piece element. Two mounting bosses 16B are protruding from the air-flow tube 16 and provide a connection to a control element 18 and a power source holder 20 via a screw 38. Two through holes (not shown in FIG. 1) are present in both the power source holder 20 and the substrate of the control element 18 in order to pass the screw 38 through both through holes and connecting the power source holder to the control element and the air-flow tube in one step. The control element 18 is sandwiched between the air-flow tube 16 and the power source holder 20, providing a compact design of the self-supporting component 12. The control element 18 includes a substrate, a printed circuit board which includes control circuitry 36. A power source 22, such as a battery is connected to the power source holder 20.

Figure 2:
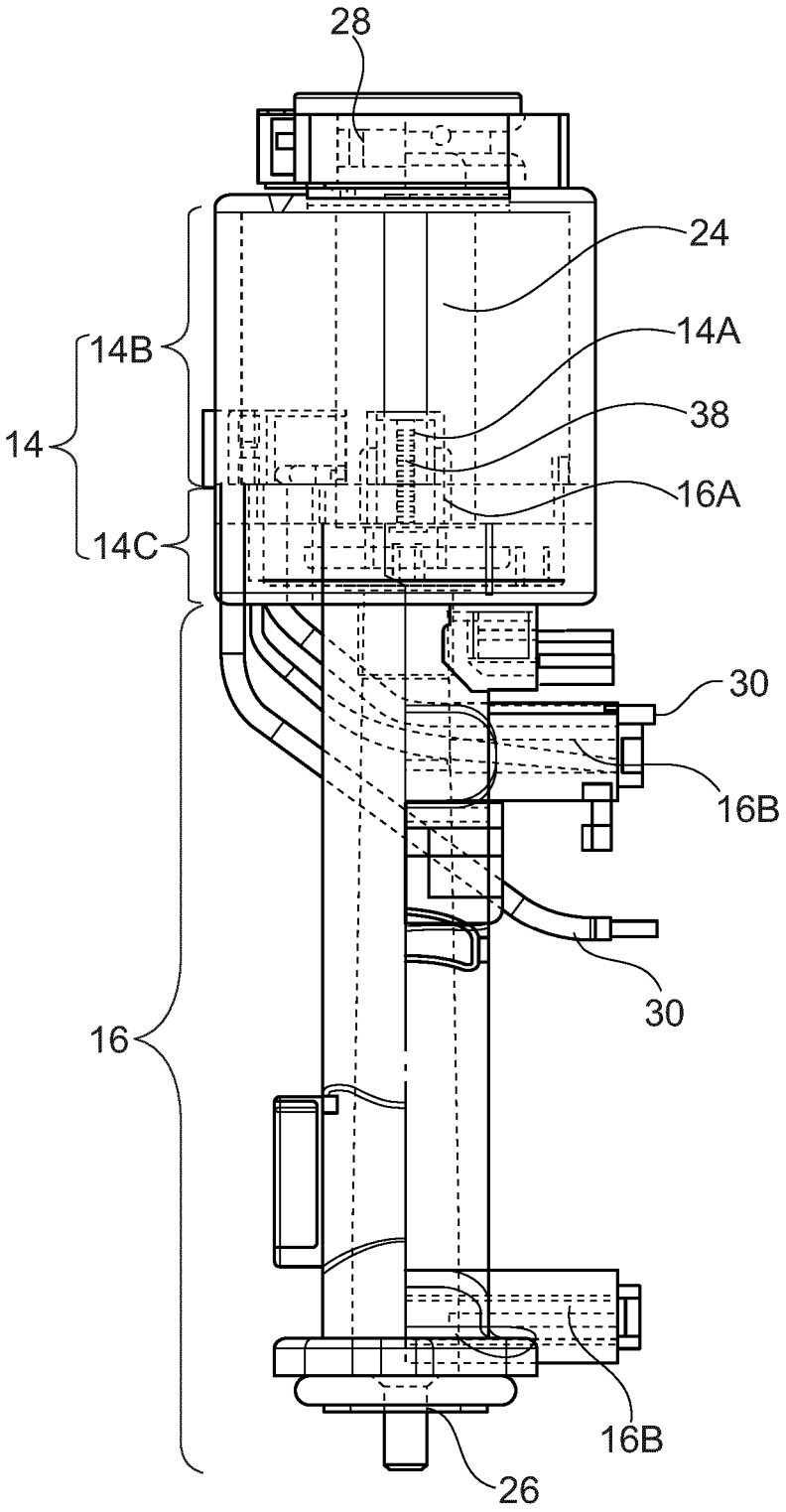
FIG. 2 shows a side view of the heater casing mounted to the air-flow tube.

FIG. 2 shows parts of the self-supporting component 12 of FIG. 1. In particular, the heater casing downstream part 14B is mounted to the one-piece element comprising the air-flow tube 16 and the heater casing upstream part 14C. The air-flow tube includes two mounting bosses 16 B for mounting the air-flow tube to the control element and the power source holder (control element and the power source holder both not shown in FIG. 2). The heater casing downstream part 14B and the heater casing upstream part 14C connected to the air-flow tube both 16 contain respective connectors 14A and 16A, which include threads for accommodating a screw 38. Upon engaging both connectors 14A and 16A with each other, the heater casing can be formed by mounting the heater casing downstream part 14B to the heater casing upstream part 14C via the screw 38. Electrical connections 30 are visible which are electrically connected to the heater positioned within the heating chamber 24 of the heater casing 14. These electrical connections can be connected to the substrate of a control element 18, in particular a printed circuit board. The heater casing 14 and the air-flow tube 16 together define the air flow path through the aerosol-generating device with the air-flow tube containing the upstream end 26 and the heater casing including the downstream end 28.

Figure 3A:
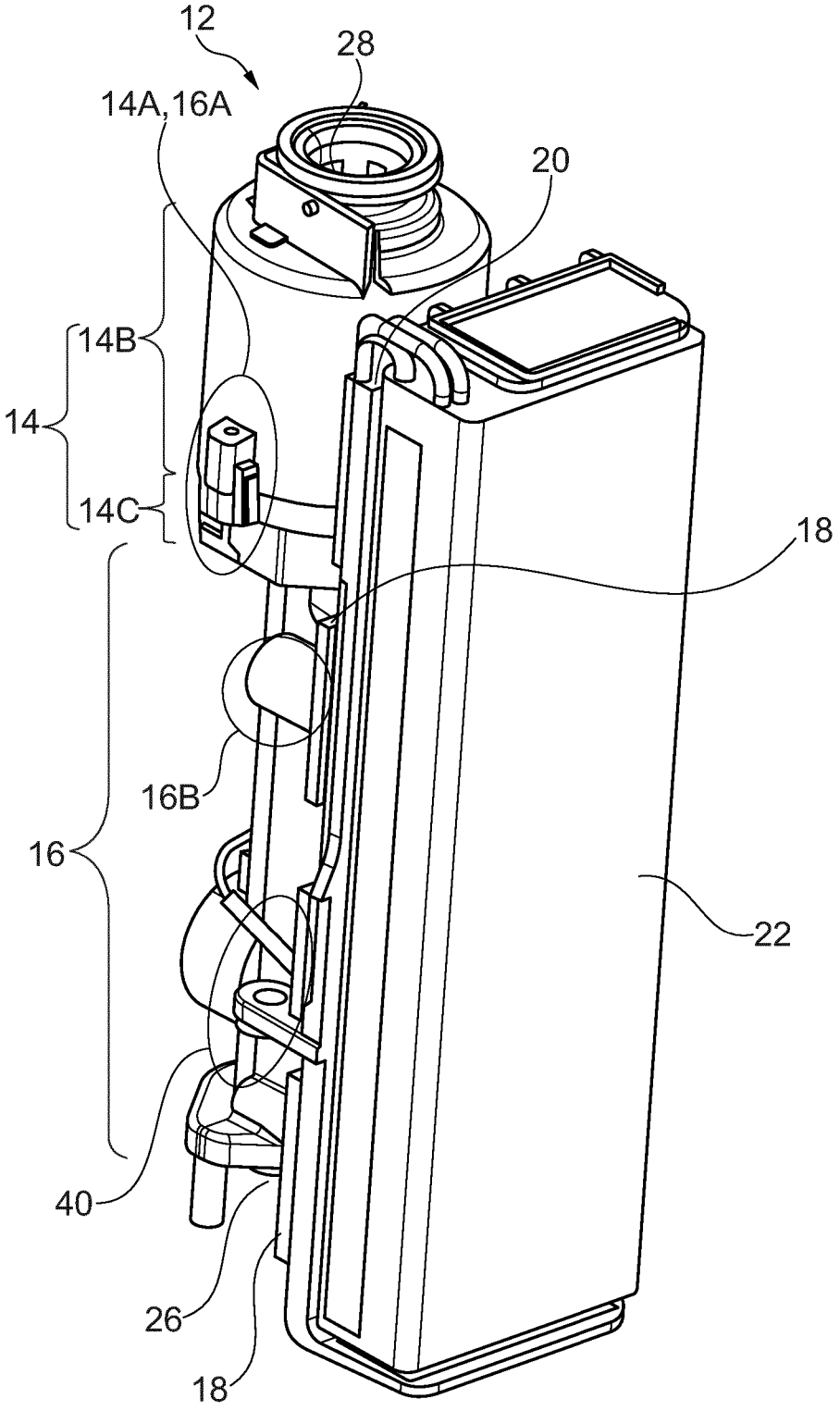
FIGS. 3A and 3B show different perspective views of a self-supporting component detailing the connections between the air-flow tube and the control element.
Figure 3B:
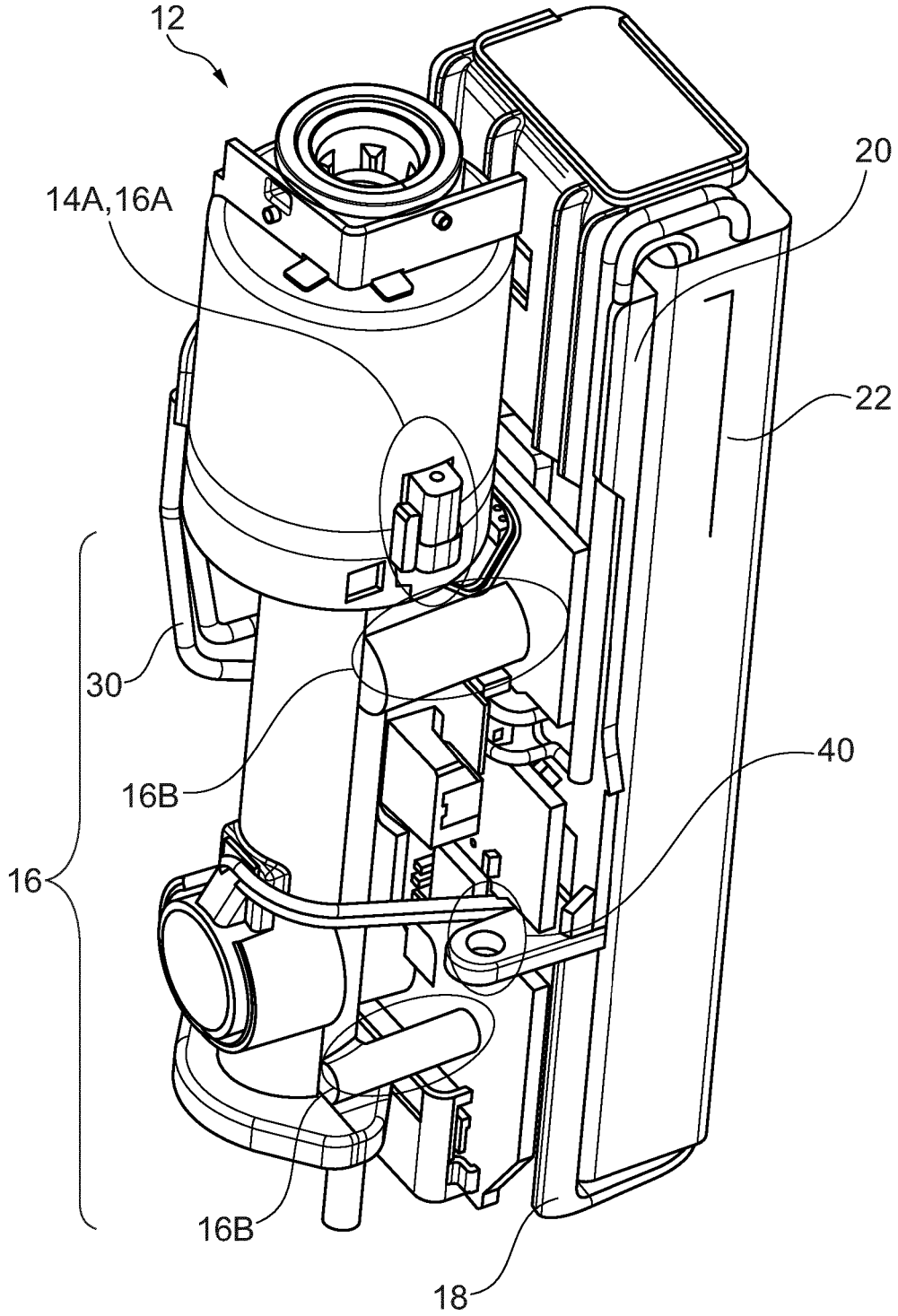

FIG. 3A and FIG. 3B show a perspective view of a self-supporting component, wherein the self-supporting component of FIG. 3B is rotated around 90° C. with respect to the self-supporting component shown in FIG. 3A. FIG. 3A shows the mounting bosses 16B which are formed as an integral part of the air-flow tube. Connectors 14A, 16A are present in the heater casing downstream part 14B and the heater casing upstream part 14C connected to the air-flow tube 16 for connection of both parts via a screw (screw not shown). The power source holder 20 furthermore includes a protrusion 40 accommodating a screw (screw not shown in FIG. 3A or 3B), which serves to connect the self-supporting component in the interior of an outer casing.

Figure 4:
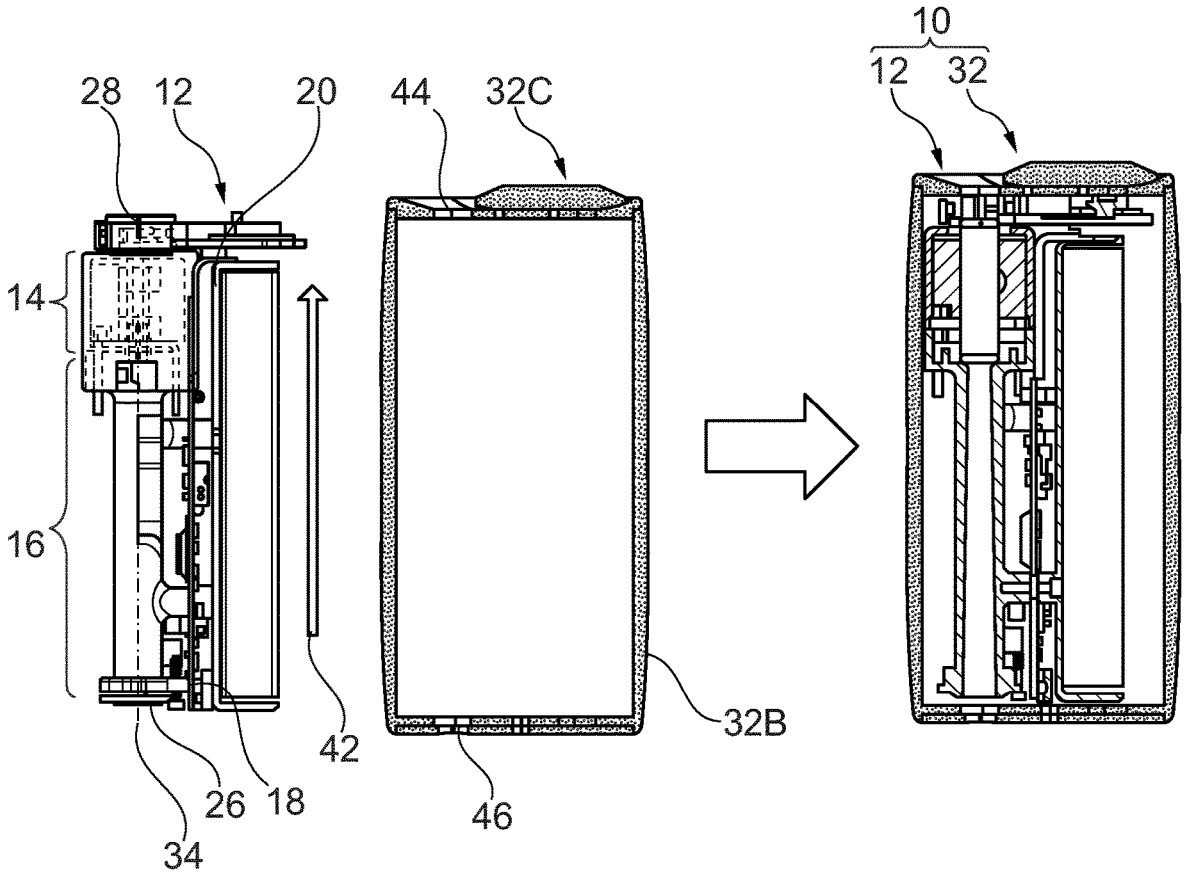
FIG. 4 shows the mounting of the self-supporting component in the interior of an outer casing.

FIG. 4 shows the incorporation of the self-supporting component 12 in an outer casing 32. On the left-hand side of FIG. 4 the self-supporting component 12 is shown, which includes a central longitudinal axis 34 which runs along the air flow path 42 of the self-supporting component from the upstream end 26 of the air-flow tube 16 to the downstream end 28 of the heater casing 14. In this embodiment, the outer casing 32 comprises an outer casing body 32B and a cover 32C. The outer casing body also contains a downstream opening 44, which coincides with the downstream end 28 of the heater casing when the self-supporting component is housed in the outer casing. Likewise, the outer casing body also includes an upstream opening 46 which coincides with the upstream end 28 of the air-flow tube 16 when the self-supporting component is located in the outer casing. The part shown on the right-hand side of FIG. 4 depicts the complete aerosol-forming device 10 including the outer casing 32 and the self-supporting component 12 housed in the interior of the outer casing. The self-supporting component 12 thereby forms an internal component of the aerosol-forming device 10. Preferably, the self-supporting component 12 includes all internal parts of the aerosol-forming device 10, so that device 10 can be assembled in a particularly easy way by introducing the self-supporting component in the interior of the outer casing and closing the outer casing.

Figure 5:
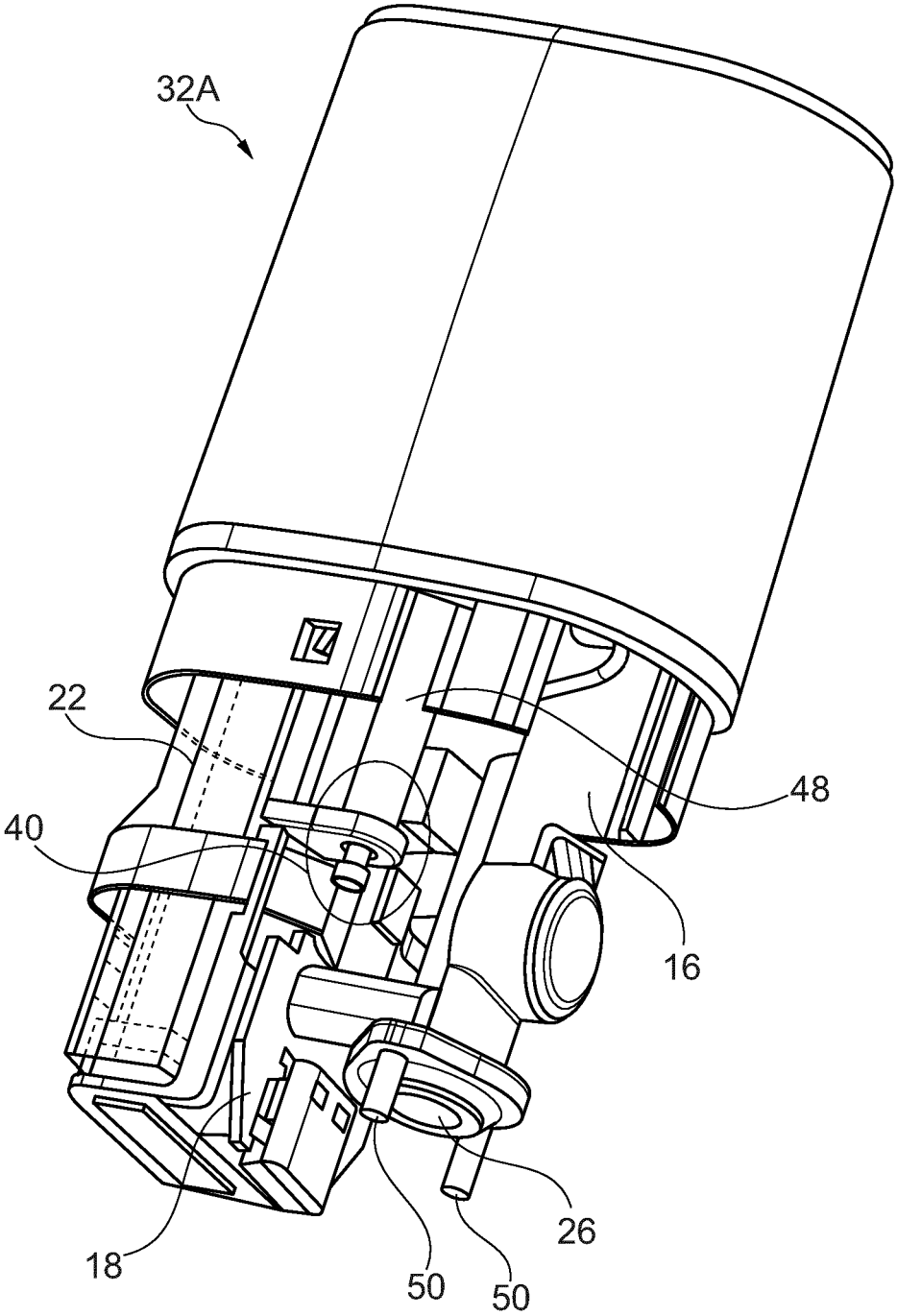
FIG. 5 shows the self-supporting component within one part of the outer casing detailing the connection between the self-supporting component and the part of the outer casing.

FIG. 5 shows a perspective view of the self-supporting component housed in the top housing 32A of the outer casing. This top housing includes a mounting boss 48 to which the self-supporting component can be mounted via the protrusion 40 of the power source holder 20 using a screw. The air-flow tube 16 contains additional mounting bosses 50 which can be used in order to connect the self-supporting component to the bottom housing of the outer casing in order to close the outer casing.

The invention claimed is:

1. An aerosol-generating device, comprising:

a heater casing housing a heating chamber, the heating chamber configured to receive an aerosol-generating article comprising an aerosol-forming substrate;

an air-flow tube configured to provide air to the heating chamber; and a control element configured to control operation of the aerosol-generating device, wherein the heater casing, the air-flow tube, and the control element are mounted to one another and form a self-supporting component of the aerosol-generating device.

2. The aerosol-generating device according to claim 1, wherein the heater casing comprises a heater casing downstream part and a heater casing upstream part.

3. The aerosol-generating device according to claim 2, wherein the heater casing upstream part and the air-flow tube are formed as a one-piece element.

4. The aerosol-generating device according to claim 2, wherein one or both of the heater casing upstream part and the heater casing downstream part comprise connections configured to mount the heater casing upstream part to the heater casing downstream part.

5. The aerosol-generating device according to claim 1, wherein the heating chamber comprises a central longitudinal axis, and wherein the air-flow tube is arranged along a central longitudinal axis of the heating chamber.

6. The aerosol-generating device according to claim 1, wherein the heater casing comprises a thermal insulation.

7. The aerosol-generating device according to claim 1, wherein the air-flow tube is mounted to the control element.

8. The aerosol-generating device according to claim 1, wherein the air-flow tube comprises at least one connector configured to mount the air-flow tube to the control element.

9. The aerosol-generating device according to claim 1, wherein the control element comprises control circuitry arranged on a supporting substrate, the supporting substrate containing at least one through hole configured to mount the control element to the air-flow tube.

10. The aerosol-generating device according to claim 1, further comprising an outer casing, wherein the self-supporting component is housed at least partly within the outer casing.

11. An aerosol-generating system comprising an aerosol-generating device according to claim 1 and an aerosol-generating article, the aerosol-generating article comprising an aerosol-forming substrate.

12. A self-supporting component for an aerosol-generating device comprising:

a heater casing configured to house a heating chamber for an aerosol-generating article;

an air-flow tube configured to provide air to the heater casing; and a control element, wherein the heater casing, the air-flow tube, and the control element are mounted on one another.

13. The self-supporting component according to claim 12, further comprising a power source holder, wherein the heater casing, the air-flow tube, the control element, and the power source holder are mounted on one another.

* * * * *